United States Patent [19]

Byers et al.

[11] Patent Number: 4,753,923

[45] Date of Patent: Jun. 28, 1988

[54] THERMALLY-TRANSFERRED NEAR-INFRARED ABSORBING DYES

[75] Inventors: Gary W. Byers; Derek D. Chapman, both of Rochester, N.Y.

[73] Assignee: Eastman Kodak Company, Rochester, N.Y.

[21] Appl. No.: 123,440

[22] Filed: Nov. 20, 1987

[51] Int. Cl.[4] ..... B41M 5/035; B41M 5/26

[52] U.S. Cl. ..... 503/227; 8/471; 427/146; 427/256; 428/195; 428/480; 428/913; 428/914

[58] Field of Search ..... 8/471; 427/146, 256; 428/195, 480, 913, 914; 503/227

[56] References Cited

U.S. PATENT DOCUMENTS

| | | | |
|---|---|---|---|
| 3,875,199 | 4/1975 | Bloom | 548/403 |
| 4,320,489 | 3/1982 | Crandall et al. | 346/135.1 |
| 4,529,684 | 7/1985 | Sasagawa et al. | 430/269 |

FOREIGN PATENT DOCUMENTS

| | | | |
|---|---|---|---|
| 192215 | 8/1986 | European Pat. Off. | 548/403 |
| 2087388 | 4/1987 | Japan | 428/913 |

*Primary Examiner*—Bruce H. Hess
*Attorney, Agent, or Firm*—Harold E. Cole

[57] ABSTRACT

A dye-donor element for thermal dye transfer comprising a support having on one side thereof a near-infrared absorbing dye comprising a dithiolene-nickel(II) complex dispersed in a polymeric binder, and on the other side thereof a slipping layer comprising a lubricant, the dye having the formula:

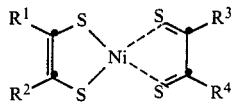

wherein each $R^1$, $R^2$, $R^3$ and $R^4$ independently represents a substituted or unsubstituted alkyl group having from 1 to about 10 carbon atoms; a substituted or unsubstituted aryl group having from about 6 to about 10 carbon atms; a substituted or unsubstitutted heterocyclic group; or $R^1$ and $R^2$ may be combined together with the carbon atoms to which they are attached to form a 5- or 6-membered carbocyclic or heterocyclic ring; or $R^3$ and $R^4$ may be combined together with the carbon atoms to which they are attached to form a 5- or 6-membered carbocyclic or heterocyclic ring.

13 Claims, No Drawings

THERMALLY-TRANSFERRED NEAR-INFRARED ABSORBING DYES

This invention relates to near-infrared absorbing dye-donor elements used in thermal dye transfer wherein the dye comprises a dithiolene-nickel(II) complex.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The system described above has been used to obtain visible dye images. There are situations, however, where it is desirable to obtain an image not substantially visible to the naked eye.

Bar-code standards for code 3 of the AIAG (Automotive Industry Action Group) Bar Code Symbology Standard AIAG-B-1-1984 specifies image density at 900 nm for reading by near-infrared readers or scanners. A somewhat similar U.S. military standard specifies density at 800 nm. Thus, a bar-code scanner could be used to read bar-codes or striped images if they had a near-infrared density.

It would therefore be desirable to provide a dye-donor element which contains a near-infrared absorbing dye. A dye image could then be thermally-transferred by a thermal print head to a receiver which would then be read by a bar-code scanner. An example of such a use would be an identification card having a thermally-transferred near-infrared dye image, serving as a security printing or background logo, to be read only by a bar-code scanner. A forger of such a card might not even be aware of the near-infrared dye image since it would not be visible to the naked eye.

U.S. Pat. No. 4,320,489 discloses metal complexes of substituted ethylene dithiols for use as an optical recording medium. EPA No. 192,215 discloses tetraphenyl-dithiolene complexes for use as an optical recording medium. U.S. Pat. No. 4,529,684 discloses the use of a benzenedithiol nickel complex for use in a laser beam recording method. U.S. Pat. No. 3,875,199 discloses metal complexes as infrared absorbers for use in sunglasses. JP No. 62/087,388 discloses a particular near-infrared absorbing agent used in a thermal transfer sheet. None of the above references, however, discloses the compounds described herein for use in a thermal dye transfer system.

In accordance with this invention, a dye-donor element for thermal dye transfer is provided comprising a support having on one side thereof a near-infrared absorbing dye dispersed in a polymeric binder, and on the other side thereof a slipping layer comprising a lubricant, the dye having the formula:

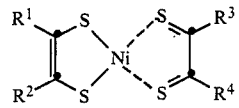

wherein each $R^1$, $R^2$, $R^3$ and $R^4$ independently represents a substituted or unsubstituted alkyl group having from 1 to about 10 carbon atoms such as $—CH_3$, $—C_2H_5$, $—CH(CH_3)_2$, $—CH_2—CH_2—O—CH_3$,

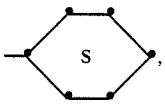

—n—$C_4H_9$, i—$C_4H_9$, t—$C_5H_{11}$; a substituted or unsubstituted aryl group having from about 6 to about 10 carbon atoms such as

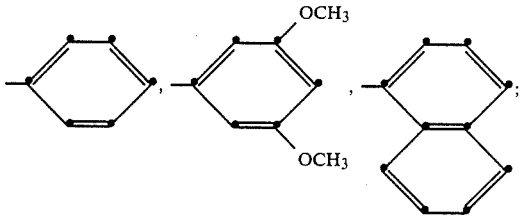

a substituted or unsubstituted heterocyclic group such as

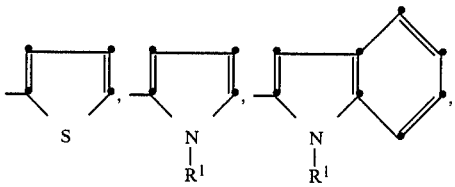

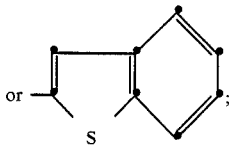

or $R^1$ and $R^2$ may be combined together with the carbon atoms to which they are attached to form a 5- or 6-membered carbocyclic or heterocyclic ring, such as

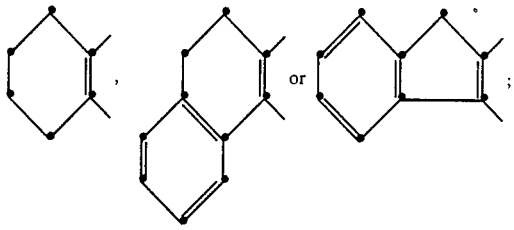

or $R^3$ and $R^4$ may be combined together with the carbon atoms to which they are attached to form a 5- or 6-membered ring such as those listed above for $R^1$ and $R^2$.

In a preferred embodiment of the invention, each of $R^1$, $R^2$, $R^3$, and $R^4$ is a substituted or unsubstituted aryl group having from about 6 to about 10 carbon atoms. In another preferred embodiment, at least one of $R^1$, $R^2$, $R^3$, and $R^4$ is phenyl.

The above complexes have substantial absorbance in the near-infrared region (750–1000 nm), minimal visible absorption (as coated or transferred, they generally appear as a light gray-green hue), good solubility for coating from common oxygenated solvents, and good thermal volatility. These properties make these complexes well-suited for printing of designs such as the bars or stripes of a bar-code and reading the near-infrared density by a scanner. The dyes employed in the invention have transferred density having adequate discrimination for a good print contrast signal for such applications.

Compounds included within the scope of the invention include the following:

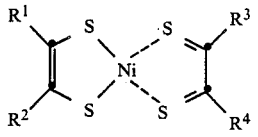

| | $R^1$ and $R^4$ | $R^2$ and $R^3$ |
|---|---|---|
| (1) | $-C_6H_5$ | $-C_3H_7-\underline{n}$ |
| (2) | $-C_6H_4(\underline{p}\text{-}OCH_3)$ | $-C_3H_7-\underline{n}$ |
| (3) | $-C_6H_4(\underline{p}\text{-}OCH_3)$ | $-CH_2C_6H_5$ |
| (4) | $-C_6H_4(\underline{p}\text{-}OCH_3)$ | $-CH_2C_6H_4(\underline{p}\text{-}OCH_3)$ |
| (5) | $-C_6H_5$ | $-C_6H_4(\underline{p}\text{-}OCH_3)$ |
| (6) | $-C_6H_5$ | $-C_6H_4(\underline{p}\text{-}OC_4H_9\underline{i})$ |
| (7) | $-C_6H_5$ | $-C_6H_4(\underline{p}\text{-}OC_{10}H_{21})$ |
| (8) | $-C_6H_5$ | $-C_6H_4(\underline{o}\text{-}OCH_3)$ |
| (9) | $-C_6H_5$ | $-C_6H_3(\underline{m}, \underline{p}\text{-}OCH_3)$ |
| (10) | $-C_6H_4(\underline{p}\text{-}OCH_2CH{=}CH_2)$ | $-C_6H_4(\underline{p}\text{-}OCH_2CH{=}CH_2)$ |
| (11) | 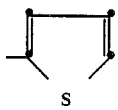 | $-C_3H_7-\underline{n}$ |

These dithiolene complexes may be prepared by established synthetic procedures, such as described in G. N. Schranzer and V. P. Mayweg, J. Am. Chem Soc., 84, 3221 (1962).

A dye-barrier layer may be employed in the dye-donor elements of the invention to improve the density of the transferred dye. Such dye-barrier layer materials include hydrophilic materials such as those described and claimed in Application Ser. No. 934,969 entitled "Dye-Barrier and Subbing Layer for Dye-Donor Element Used in Thermal Dye Transfer" by Vanier, Lum and Bowman, filed Nov. 25, 1986.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-coacrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired.

The reverse side of the dye-donor element is coated with a slipping layer to prevent the printing head from sticking to the dye-donor element. Such a slipping layer would comprise a lubricating material such as a surface active agent, a liquid lubricant, a solic lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the near-infrared dye thereon as described above or may have alternating areas of other different dyes, such as sublimable magenta and/or yellow and/or cyan and/or black or other dyes. Such dyes are disclosed in U.S. Pat. No. 4,541,830, the disclosure of which is hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, yellow, cyan and the near-infrared dye as described above, and the above process steps are sequentially performed for each color to obtain a three-color dye transfer image containing a near-infrared dye image. Of course, when the process is only performed for a single color, then a monochrome dye transfer image is obtained.

Thermal printing heads which can be used to transfer dye from the dye-donor elements of the invention are available commerically. There can be employed, for example, a Fujitsu Thermal Head (FTP-040 MSCOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a multi-color image is to be obtained, the above assemblage is formed on several occasions during the time when heat is applied by the thermal printing head. After the first dye is transferred, the elements are peeled apart. A second dye-donor element (or another area of the donor element with a different dye area) is then brought in register with the dye-receiving element and the process repeated. The other colors are obtained in the same manner.

The following examples are provided to illustrate the invention.

EXAMPLE 1

A dye-donor element was prepared by coating the following layers in the order recited on a 6 μm poly(ethylene terephthalate) support:

(1) subbing layer of duPont Tyzor TBT® titanium tetra-n-butoxide (0.16 g/m$^2$) from 1-butanol; and (2) a dye layer containing the near-infrared dye as identified above or control dye identified below (0.27 g/m$^2$) in a cellulose acetate butyrate (17% butyryl and 28% acetyl) binder (0.32 g/m$^2$) coated from a tetrahydrofuran, acetone and cyclohexanone solvent mixture. On the back side of the element was coated:

(1) a subbing layer of Bostik 7650® (Emhart Corp.) polyester (0.16 g/m$^2$) coated from a toluene and 3-pentanone solvent mixture; and (2) a slipping layer of Gafac RA-600® (GAF Corp.) polymer (0.043 g/m$^2$) and BYK-320® (BYK Chemie, USA) (0.011 g/m$^2$) in a poly(styrene-co-acrylonitrile) binder (70:30 wt. ratio) (0.54 g/m$^2$) coated from a toluene and 3-pentanone solvent mixture.

A dye-receiving element was prepared by coating a solution of Makrolon 5705® (Bayer A. G. Corporation) polycarbonate resin (2.9 g/m$^2$) in a methylene chloride and trichloroethylene solvent mixture on a 175 μm polyethylene terephthalate support containing titanium dioxide.

The dye side of the dye-donor element strip one inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head L-133 (No. C6-0242) and was pressed with a spring at a force of 8 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at increments from 0 up to 8.3 msec to generate a graduated density test pattern. The voltage supplied to the print head was approximately 21 v representing approximately 1.7 watts/dot (12 mjoules/dot).

The dye/receiving element was separated from the dye-donor element and the reflection density of the transferred image was read from 600 to 1000 nm. The λ-max was calculated and the densities at λ-max and 900 nm were recorded. The following results were obtained:

TABLE 1

| | | Transferred Reflection Density | |
|---|---|---|---|
| Dye | λ-max (nm) | D-max | at 900 nm |
| 1 | 800 | 1.27 | 0.54 |
| 2 | 832 | 1.24 | 0.87 |
| 3 | 830 | 0.87 | 0.59 |
| 4 | 838 | 0.76 | 0.55 |
| 5 | 905 | 0.44 | 0.44 |
| 6 | 910 | 0.92 | 0.92 |
| 7 | 906 | 0.88 | 0.87 |
| 8 | 856 | 0.96 | 0.79 |
| 9 | 922 | 0.92 | 0.87 |
| 10 | 933 | 0.60 | 0.87 |
| 11 | 870 | 1.08 | 1.05 |
| C-1 | 900 | 0.01 | 0.01 |
| C-2 | 813 | 0.16 | 0.09 |

Control near-infrared absorbing dyes:

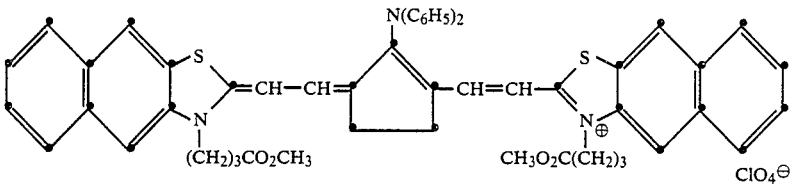

C-1

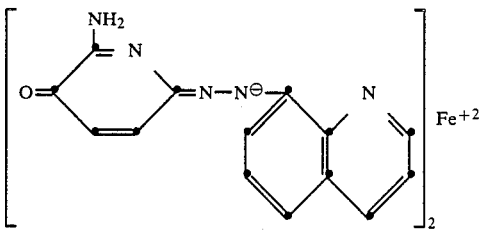

C-2

(Similar to dyes described in DE 2,236,269)

The data show that the nickel(II) dithiolene dyes of the invention all have superior transfer and absorption characteristics in the near infrared region compared to two control dyes.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a near-infrared absorbing dye dispersed in a polymeric binder, and on the other side thereof a slipping layer comprising a lubricant, said dye having the formula:

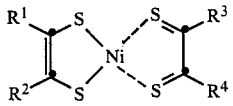

wherein each $R^1$, $R^2$, $R^3$ and $R^4$ independently represents a substituted or unsubstituted alkyl group having from 1 to about 10 carbon atoms; a substituted or unsubstituted aryl group having from about 6 to about 10 carbon atoms; a substituted or unsubstituted heterocyclic group; or $R^1$ and $R^2$ may be combined together with the carbon atoms to which they are attached to form a 5- or 6-membered carbocyclic or heterocyclic ring; or $R^3$ and $R^4$ may be combined together with the carbon atoms to which they are attached to form a 5- or 6-membered carbocyclic or heterocyclic ring.

2. The element of claim 1 wherein each of $R^1$, $R^2$, $R^3$, and $R^4$ is a substituted or unsubstituted aryl group having from about 6 to about 10 carbon atoms.

3. The element of claim 1 wherein at least one of $R^1$, $R^2$, $R^3$, and $R^4$ is phenyl.

4. The element of claim 1 wherein $R^1$ and $R^4$ are each

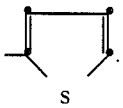

5. The element of claim 1 wherein said dye donor element comprises sequential repeating areas of magenta, yellow, cyan, and said near-infrared dye.

6. In a process of forming a dye transfer image comprising imagewise-heating a dye-donor element comprising a support having thereon a dye layer comprising a dye dispersed in a polymeric binder, and transferring a dye image to a dye-receiving element to form said dye transfer image, the improvement wherein said dye is a near-infrared absorbing dye having the formula:

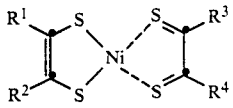

wherein each $R^1$, $R^2$, $R^3$ and $R^4$ independently represents a substituted or unsubstituted alkyl group having from 1 to about 10 carbon atoms; a substituted or unsubstituted aryl group having from about 6 to about 10 carbon atoms; a substituted or unsubstituted heterocyclic group; or $R^1$ and $R^2$ may be combined together with the carbon atoms to which they are attached to form a 5- or 6-membered carbocyclic or heterocyclic ring; or $R^3$ and $R^4$ may be combined together with the carbon atoms to which they are attached to form a 5- or 6-membered carbocyclic or heterocyclic ring.

7. The process of claim 6 wherein each of $R^1$, $R^2$, $R^3$, and $R^4$ is a substituted or unsubstituted aryl group having from about 6 to about 10 carbon atoms.

8. The process of claim 6 wherein at least one of $R^1$, $R^2$, $R^3$, and $R^4$ is phenyl.

9. The process of claim 6 wherein said support is poly(ethylene terephthalate) which is coated with sequential repeating areas of magenta, yellow, cyan, and said near-infrared absorbing dye, and said process steps are sequentially performed for each color to obtain a visible three-color dye transfer image and a near-infrared absorbing dye image.

10. In a thermal dye transfer assemblage comprising:

(a) a dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye is a near-infrared absorbing dye having the formula:

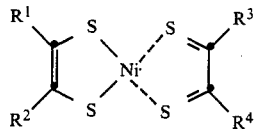

wherein each $R^1$, $R^2$, $R^3$ and $R^4$ independently represents a substituted or unsubstituted alkyl group having from 1 to about 10 carbon atoms; a substituted or unsubstituted aryl group having from about 6 to about 10 carbon atoms; a substituted or unsubstituted heterocyclic group; or $R^1$ and $R^2$ may be combined together with the carbon atoms to which they are attached to form a 5- or 6-membered carbocyclic or heterocyclic ring; or $R^3$ and $R^4$ may be combined together with the carbon atoms to which they are attached to form a 5- or 6-membered carbocyclic or heterocyclic ring.

11. The assemblage of claim 10 wherein each of $R^1$, $R^2$, $R^3$, and $R^4$ is a substituted or unsubstituted aryl group having from about 6 to about 10 carbon atoms.

12. The assemblage of claim 10 wherein at least one of $R^1$, $R^2$, $R^3$, and $R^4$ is phenyl.

13. The assemblage of claim 10 wherein said support of the dye-donor element comprises poly(ethylene terephthalate).

* * * * *